United States Patent [19]

Kirkland

[11] 4,289,206

[45] Sep. 15, 1981

[54] REMOTE MULTIPLE STRING WELL COMPLETION

[75] Inventor: Kerry G. Kirkland, Houston, Tex.

[73] Assignee: Armco Inc., Middletown, Ohio

[21] Appl. No.: 67,745

[22] Filed: Aug. 20, 1979

[51] Int. Cl.[3] ..... E21B 23/00; E21B 33/076

[52] U.S. Cl. ..... 166/348; 166/75 A; 166/85; 166/341; 285/24; 285/39; 285/140

[58] Field of Search ..... 166/85, 87, 88, 75 A, 166/341, 348, 237, 315; 285/24, 25, 39, 137 A, 140, 341

[56] References Cited

U.S. PATENT DOCUMENTS

| | | | |
|---|---|---|---|
| 3,287,030 | 11/1966 | Crain et al. | 285/140 X |
| 3,603,401 | 9/1971 | Nelson et al. | 166/89 X |
| 3,661,206 | 5/1972 | Putch et al. | 166/89 X |
| 3,688,841 | 9/1972 | Baugh | 166/89 X |
| 3,693,714 | 9/1972 | Baugh | 166/348 |
| 3,741,294 | 6/1973 | Morrill | 166/89 X |
| 3,800,869 | 4/1974 | Herd et al. | 166/337 |
| 3,807,497 | 4/1974 | Baugh | 166/87 X |
| 3,847,215 | 11/1974 | Herd | 166/337 |
| 3,871,449 | 3/1975 | Ahlstone | 285/140 X |
| 3,971,576 | 7/1976 | Herd et al. | 166/348 X |

*Primary Examiner*—Stephen J. Novosad

*Attorney, Agent, or Firm*—Roylance, Abrams, Berdo & Farley

[57] ABSTRACT

In a remotely installed underwater well apparatus, a tubular body, typically a multiple string tubing hanger, is landed in a position oriented rotationally with respect to a reference point on the apparatus and a seal device is then energized by the same tool employed to land and orient the tubular body.

6 Claims, 5 Drawing Figures

REMOTE MULTIPLE STRING WELL COMPLETION

RELATED APPLICATION

Method and apparatus features disclosed in this application are also disclosed and claimed in my copending application Ser. No. 067,733, filed concurrently herewith.

BACKGROUND OF THE INVENTION

When multiple string wells are installed under water, with the wellhead at or near the bottom of the body of water, it is necessary not only to land devices such as the tubing hanger body by remote operations but also to orient the landed device rotationally with respect to a reference point on the underwater structure. Prior-art workers have devoted much attention to the problems involved in such installations, and the following U.S. Pat. Nos. show typical methods and apparatus which have been proposed: 3,603,401 Nelson et al 3,661,206 Putch et al 3,688,841 Baugh, 3,693,714 Baugh, 3,742,294 Morrill, 3,800,869 Herd et al 3,807,497 Baugh, 3,847,215 Herd.

Despite extensive prior art effort and considerable success in the field, there has been a continuing need for improvement and simplification, particularly with reference to sealing the hanger body after it has been landed and oriented.

OBJECTS OF THE INVENTION

A general object is to simplify both the apparatus and the manipulative procedure required to land and rotationally orient a multiple string tubing hanger remotely in an underwater well installation.

Another object is to devise an improved handling tool for use in remotely installing devices which must be sealed with respect to the surrounding structure.

A further object is to allow the seal or packoff device of a remotely installed tubing hanger body to be energized simply by a final increment of downward movement of the handling tool employed to land the hanger body in rotationally oriented position.

SUMMARY OF THE INVENTION

The invention applies to remote installation of an underwater well component, typically a multiple string tubing hanger, which require both rotational orientation and sealing after the component has been landed. Working above water, an annular seal device is placed on the tubing hanger, and a handling tool is provided which has both a body member and a sleeve which carries locator means to cooperate with, e.g., a locator groove presented by the wellhead member or other tubular support structure, the sleeve surrounding the body of the handling tool and being rotatable relative thereto. The sleeve is releasably secured against rotation relative to the handling tool body, as by inserting one or more shear pins. The tubing hanger is then releasably attached to the body member of the handling tool, as by latching segments, in such fashion that the handling tool can be rotated, relative to the tubing hanger, between a first position, in which the handling tool is blocked against downward movement relative to the tubing hanger, and a second position, in which the handling tool is unblocked and can be moved downwardly a significant distance relative to the hanger. The combination of hanger and handling tool thus assembled is then run down to the wellhead or other tubular support structure, as by use of a handling string, until the tubing hanger has been landed. The entire combination of tubing hanger and handling tool is then rotated until the locator means of the handling tool coacts with the rotational orientation reference means of the tubular support structure. The body member of the handling tool is then released from the sleeve member, typically by rotating the handling string to shear the shear pins while the sleeve member is restrained by the locator means. The body member of the handing tool is then rotated relative to the tubing hanger and the sleeve member to bring the body member to its unblocked second position. The handling tool is then lowered relative to the tubing hanger, with that increment of downward motion serving to axially compress the seal device to energize the same and, advantageously, also to detach the handling tool from the tubing hanger preparatory to recovery of the handling tool.

IDENTIFICATION OF THE DRAWINGS

In order that the manner in which the foregoing and other objects are achieved according to the invention can be understood in detail, one particularly advantageous apparatus embodiment of the invention, and the method as practiced therewith, will be described with reference to the accompanying drawings, which form part of the original disclosure of this application, and wherein:

FIG. 1 is a vertical axial cross-sectional view showing installation of a multiple string tubing hanger body in an upper wellhead body of an underwater installation;

FIGS. 2 and 3 are transverse cross-sectional views taken generally on lines 2—2 and 3—3, FIG. 1;

FIG. 4 is a fragmentary side elevational view of a portion of the apparatus of FIG. 1; and FIG. 5 is a view similar to FIG. 1 but with the packer between the hanger body and the wellhead body energized.

DETAILED DESCRIPTION OF APPARATUS

Figure 1:
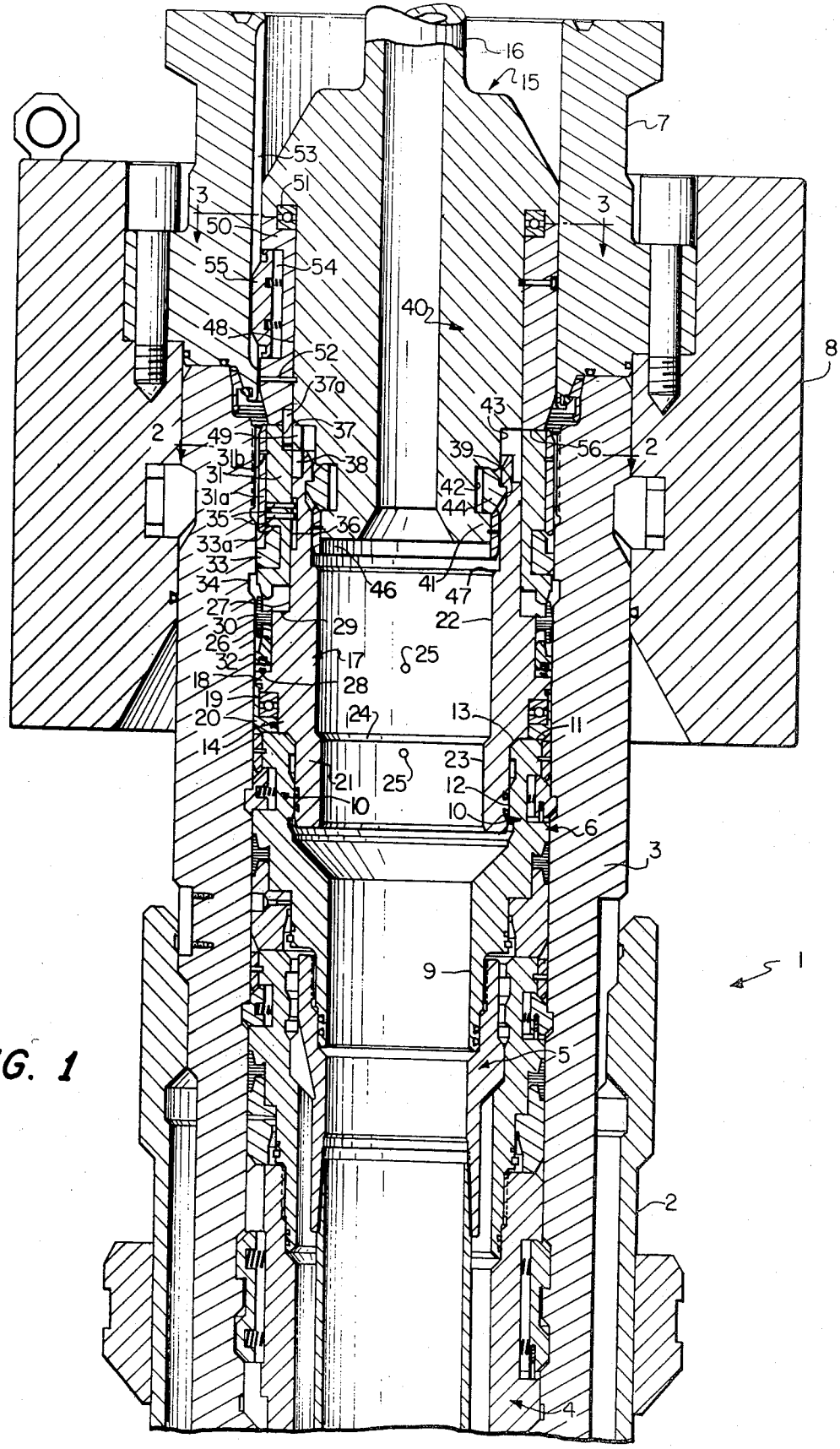
Figure 2:
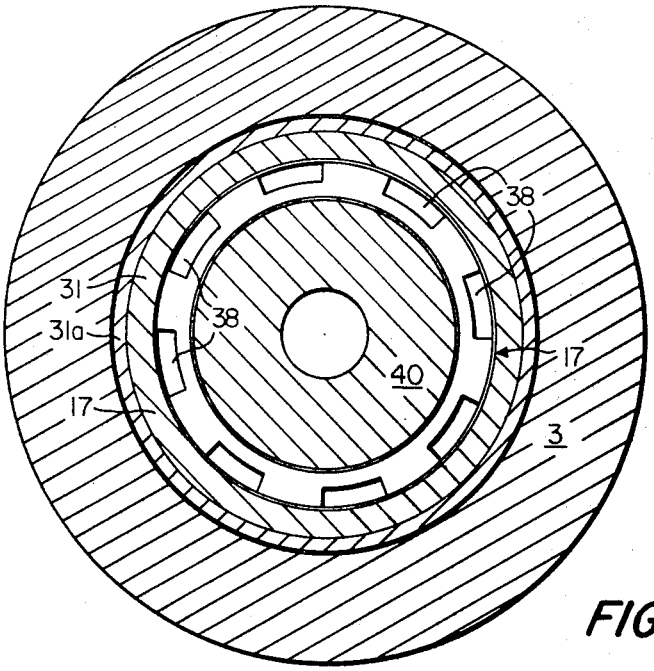
Figure 3:
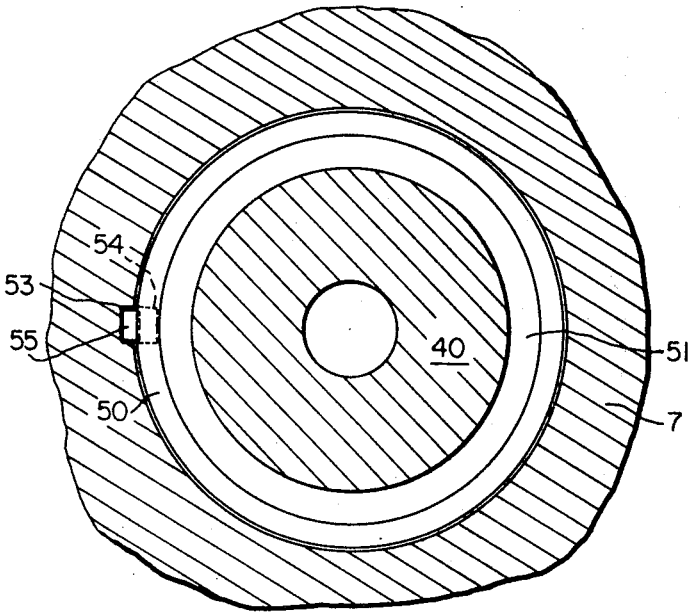
Figure 4:
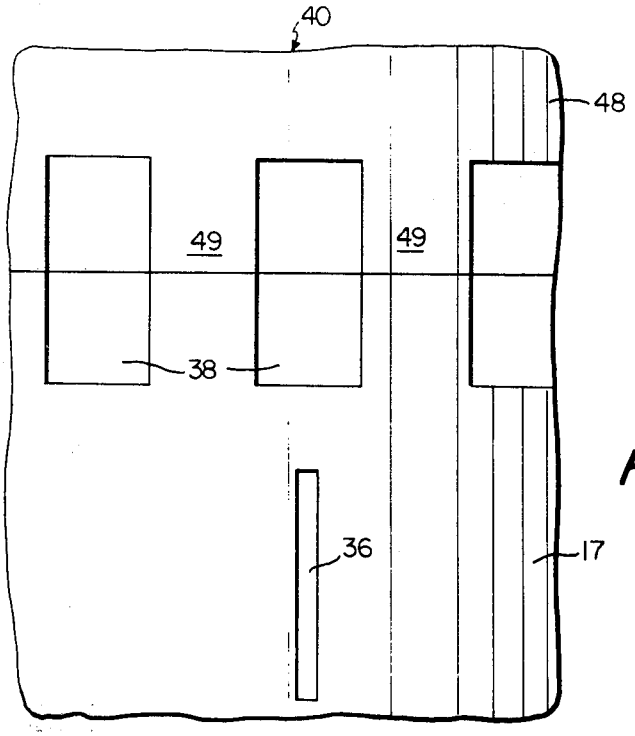

Referring first to FIGS. 1-4, the invention is illustrated as applied to remote installation of two tubing strings in a well including an underwater wellhead indicated generally at 1 comprising surface casing 2, a wellhead body 3 installed in the surface casing, casing hangers 4 and 5 supported in body 3 and each supporting a string of casing, a mandrel packing unit 6, a wellhead upper body 7, and a remotely operated connector 8 securing upper body 7 to the top of body 3. Connector 8 can be of any suitable conventional type, such as that shown in U.S. Pat. No. 3,228,715 to Neilon et al. Body 7 is equipped with guide arms (not shown) to cooperate with the guide posts of the usual primary guide system (not shown) so that, when landed and secured by connector 8 to body 3, body 7 is in a known rotational position relative to the guide posts. Packing unit 6 has a main body including a lower portion 9, having an inner diameter equal to that of the string of casing suspended from hanger 5, and an upper portion 10 which is of substantially larger internal diameter. Upper portion 10 presents a flat transverse annular upper end face 11, a right cyclindrical inner surface 12, and a downwardly and inwardly tapering frusto-conical shoulder 13 which joins face 11 and surface 12.

Preparatory to installation of the tubing strings, a tubing hanger body or bushing 14 is installed by use of a handling tool 15 manipulated by the usual handling string 16. Hanger body 14 comprises a tubular main body 17 having an intermediate portion 18 of outer diameter such as to fill the bore of wellhead body 3. Below portion 18, the outer diameter of body 17 is reduced to accommodate an antifriction thrust bearing 19, which can be a conventional ball bearing or roller bearing disposed between a spacer ring 20 and the downwardly facing shoulder presented by intermediate portion 18. Lower end portion 21 of body 17 is of further reduced outer diameter so as to be slidably received by the inner wall 12 of the upper portion of casing hanger 6. When hanger body 14 is fully landed, it is supported via bearing 19 on the upper end face 11 of casing hanger 6.

The bore of body 17 is cylindrical, including an upper portion 22 of larger diameter. a lower portion 23 of smaller diameter, and an intermediate transverse annular upwardly facing shoulder 24. Two verically aligned orienting pins 25 project radially inwardly from the wall of the bore of body 17, one above and one below shoulder 24, for a purpose later described.

Above intermediate portion 18, body 17 has a first portion 26 of reduced outer diameter and, thereabove, a second portion 27 of still smaller outer diameter so that a first transverse annular upwardly facing shoulder 28 is provided between portions 18 and 26, and a second such shoulder 29 is provided between portions 26 and 27. Portions 26 and 27 accommodate a seal unit comprising an elastomeric packing ring 30, disposed between an actuator sleeve 31 and a compression ring 32, ring 32 being adjacent shoulder 28 and sleeve 31 slidably embracing portion 27 of body 17. Sleeve 31 has an outwardly opening transverse groove which accommodates latch segments 33, the segments being spring biased outwardly for engagement in a transverse annular inwardly opening groove 34 in wellhead body 3. Segments 33 have upwardly and inwardly slanting camming surfaces **33*a* which are exposed upwardly when the segments are engaged in groove 34. An actuator sleeve 31*a* slidably embraces sleeve 31 above segments 33 and is initially fixed to sleeve 31 by shear pins at 31*b***.

Sleeve 31 is provided with two orienting pins 35 which project radially inwardly from the sleeve into slidable engagement in a vertical external slot 36 in the upper end portion of body 17. A key slot 37 opens upwardly at the upper end of sleeve 31. Thus, if the rotational position of key slot 37 is predetermined, the rotational location of orienting pins 25 will likewise be predetermined. The upper end of body 17 is provided with a circumferentially spaced series of upwardly opening notches 38.

Hanger body 14 is mounted on handling tool 15 before running the combination of tool and hanger body. The upper end portion of body 17 is provided with a transverse annular inwardly opening groove 39. Tool 15 includes a main body 40 having a lower end portion 41 of smaller outer diameter, a transverse annular outwardly opening groove 42 at the upper end of portion 41, and a portion 43 located immediately above groove 42 and having an outer diameter such as to be slidably embraced by the inner surface of the portion of body 17 above groove 39. A plurality of latch segments 44 are disposed in groove 42 and urged outwardly by springs (not shown), segments 44 having lower camming faces 45 which slant downwardly and inwardly. Secured to body 40 by shear pins, an actuating ring 46 slidably embraces lower end portion 41 of body 40 and projects therebelow. Ring 46 is in turn slidably embraced by the upper end portion of body 17 which is of slightly enlarged inner diameter so as to present a transverse annular upwardly directed shoulder 47 against which ring 46 can be driven, as later described, to retract segments 44.

Above portion 43, body 40 has a larger diameter portion 48, and at the juncture between portions 48 and 43, portion 48 is provided with a plurality of downwardly projecting circumferentially spaced lugs 49 dimensioned and shaped to be accommodated respectively by notches 38 on body 17. Notches 38 are rectangular, mutually identical and equally spaced. Lugs 49 are likewise rectangular and equally spaced. When hanger body 14 is mounted on handling tool 15, the rotational position of body 17 relative to body 40 is such that lugs 49 are aligned with the spaces between notches 38, the lower edges of the lugs thus engaging portions of the upper end face of body 17.

The outer right cylindrical surface of portions 48 of body 40 is slidably embraced by a sleeve 50 having an outer diameter such as to be slidably embraced by the wall of the bore of wellhead upper body 7. The upper end portion of body 40 is enlarged to project outwardly over the upper end of sleeve 50, and an antifriction thrust bearing 51, such as a ball bearing or a roller bearing, is interposed between the upper end of the sleeve and the enlarged upper end portion of body 40. Sleeve 50 is initially fixed to body 40, as by shear pins 52.

Wellhead upper body 7 is provided with a vertical inwardly opening locator groove 53 and, since body 7 is landed conventionally in a known position relative to the guide posts of the usual permanent guide base (not shown), the orientation of groove 53 is predetermined with reference to the permanent guide base. Sleeve 50 has a vertical outwardly opening slot 54 which accommodates a locator key 55 urged outwardly by springs as shown. Lower end face 56 of sleeve 50 is dimensioned for flush engagement with the upper end face of sleeve 31 and is provided with a downwardly projecting key **37*a* which cooperates with the upwardly opening locator slot 37 of sleeve 31**.

When the combination of hanger body 14 and handling tool 15 is run in, spacer ring 20 of bearing 19 lands on upper end face 11 of mandrel packing unit 6, allowing the combination of hanger body 14 and tool 15 to be rotated, by manipulation of handling string 16, until locator key 55 on sleeve 50 snaps into locator groove 53 in wellhead upper body 7. Since sleeve 50 is rotationally fixed on sleeve 31 by key 37, and sleeve 31 is in turn rotationally fixed on body 17 of the hanger by pins 35, engagement of key 55 in groove 53 establishes a given rotational orientation of the orienting pins 25 of the hanger body with reference to wellhead upper body 7.

Figure 5:
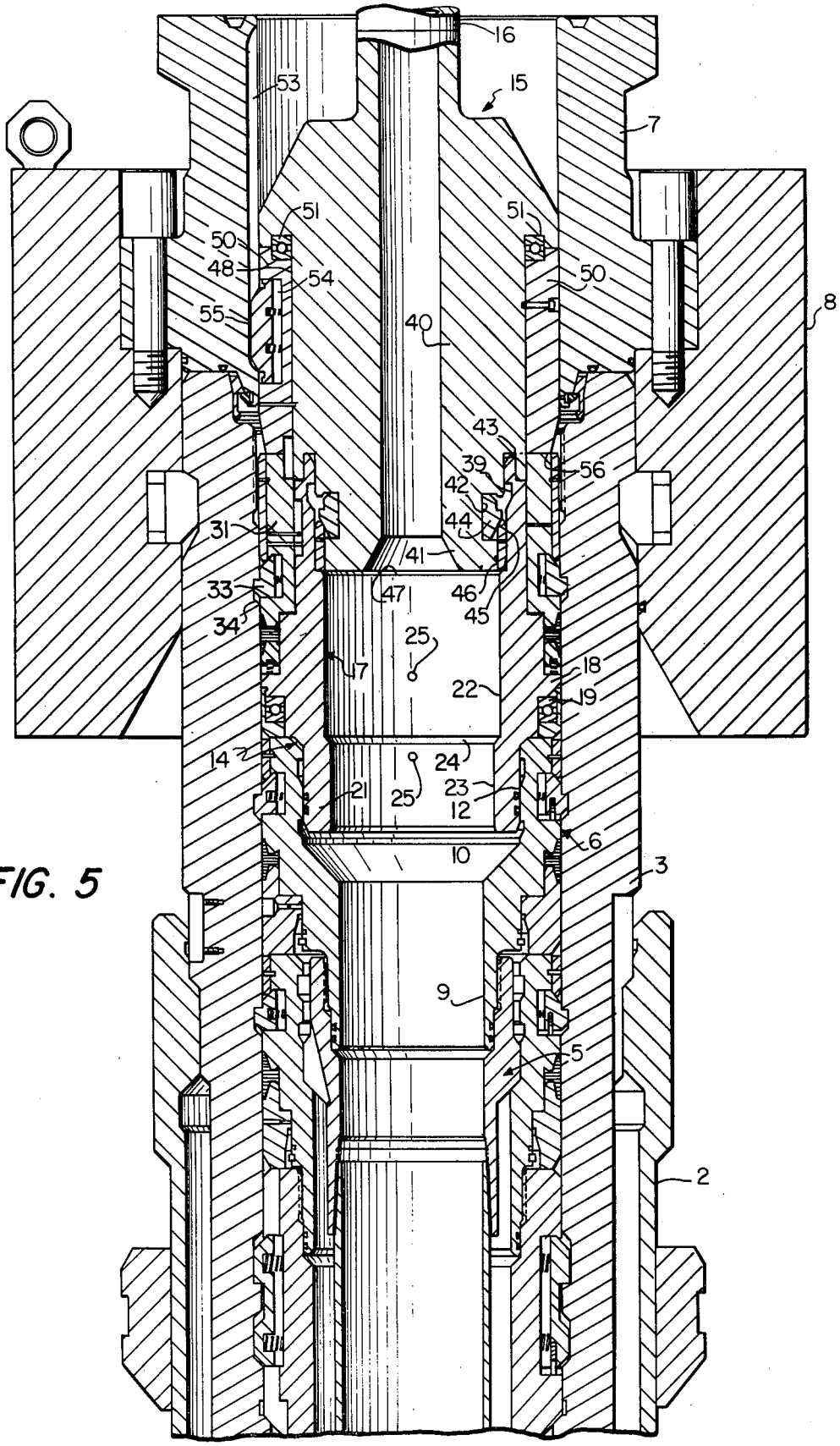

With key 55 engaged in groove 53, further rotation of the handling string shears the pins 52, freeing tool body 40 for rotation relative to the combination of sleeve 50 and hanger body 14. The handling string is now rotated until lugs 49 are aligned with notches 38 and body 40 and its sleeve 50 are allowed to descend a distance equal to the depth of notches 38, bringing the elements to the condition seen in FIG. 5. Such downward movement causes sleeve 31 to move downwardly relative to body 17 so that, with ring 32 engaging shoulder 28, packing ring 30 is compressed between ring 32 and sleeve 31 and is forced into good sealing engagement with the wall of the bore of wellhead body 3 as well as with the lower end of sleeve 31 and with ring 32. Such downward movement of sleeve 50 also drives sleeve 31 downwardly far enough to bring segments 33 into alignment with groove 34, so that the segments snap outwardly into the groove to secure sleeve 31 in its packing-energizing position. Simultaneously with energization of the packing, descent of tool body 40 relative to hanger body 14 causes sleeve 46 to engage shoulder 47 so that completion of the downward movement of the tool body causes camming surfaces 45 of latch segments 44 to ride over the upper end of sleeve 46, with the segments thus being retracted into groove 42. Sleeve 46 remains in its segment-retracting position by reason of frictional engagement with tool body portion 41 and the tool is thus free to be removed by the handling string, leaving hanger body 14 latched to wellhead body 3.

METHOD EMBODIMENT

It is apparent the complete use of the apparatus of FIGS. 1–4 represents one method embodiment of the invention and that the method comprises certain steps carried out preliminarily at the operational base, e.g., the vessel or platform from which the well is drilled and completed, and additional steps carried out remotely from the operational base. Thus, the tubing hanger body 14, with upper reduced diameter portions 26 and 27, is provided on the operational base, and the annular seal device comprising packing ring 30, actuator sleeve 31 and compression ring 32 is installed on portions 26 and 27, either prior to delivery of the hanger to the operational base or upon delivery. The complete handling tool 15 is also provided on the operational base, and sleeve 50 is secured against rotation relative to body 40 by shear pins 52.

Still working at the operational base, hanger 14 is releasably attached to handling tool 15 by inserting lower end portion 41 of the body of the tool downwardly into the bore of the hanger, orienting the tool to align key **37*a* with slot 37, and bring the key into the slot so that the main body of the tool occupies a first rotational position relative to the hanger such that lugs 49 are offset from notches 38 and the upper end face of the hanger body therefore blocks tool body 40 against further downward movement, relative to the hanger. With the hanger thus attached to the handling tool, relative rotation between body 40 and aleeve 50 of the tool is prevented by shear pins 52, relative rotation between tool sleeve 50 and seal actuating sleeve 31 is prevented by coaction of key 37*a* and slot 37, and hanger 14 is retained against rotation relative to the handling tool because of engagement of pins 35 in slot 36**.

Using handling string 16, the combination of the handling tool and attached tubing hanger is run down until the hanger seats on shoulder 13. With the tubing hanger thus landed, the handling string is rotated to rotate both the handling tool and the tubing hanger, until key 55 engages in reference slot 53. Such engagement causes rotation to stop. Torque on the handling string is now increased enough to shear pins 52. When pins 52 shear, handling tool body 40 begins to turn with the handling string while the combination of tool sleeve 50, seal actuating sleeve 31 and tubing hanger 14 remain in their known rotational orientation, fixed against rotation because key 55 is engaged in slot 53. Rotation of tool body 40 relative to the tubing hanger brings lugs 49 into respective alignment with notches 38, so the tool body is now unblocked and, under the weight of the handling string, moves downwardly relative to the hanger, with lugs 49 entering notches 38. Tool sleeve 50 and seal actuating sleeve 31 move downwardly with the main tool body, so that packing ring 30 is compressed axially between sleeve 31 and ring 32 and the packing ring is thereby energized to seal between the surrounding wall of wellhead member 3 and surface 26 of the tubing hanger. The amount of downward movement allowed tool body 40 by the dimensions of slots 38 and lugs 49 is such that latch segments 33 are lowered into alignment with groove 34 and sleeve 31 is latched in its lowered, seal-energizing position.

What is claimed is:

1. For use in installing multiple string underwater well apparatus of the type comprising a tubular support structure located under water above the well bore and having an internal support surface and rotational orientation reference means located above the support surface, the combination of a tubular hanger body adapted to be landed on the support surface and having stop surface means comprising an annular series of circularly spaced upwardly directed stop surfaces lying in a common place at right angles to the longitudinal axis of the hanger body;

seal means carried by the hanger body for sealing between the hanger body and a surrounding portion of the tubular support structure after the hanger body has been landed, the seal means comprising an energizable seal ring surrounding the hanger body, an actuating sleeve slidably embracing the hanger body above the seal ring, and means restraining the actuating ring from rotational movement relative to the hanger body, and a handling tool comprising a main body connectable to a handling string and provided with an annular series of circularly spaced downwardly projecting lugs dimensioned and disposed to engage the respective stop surfaces of said stop surface means when the handling tool is in a first rotational position relative to the hanger body and to extend between adjaent respective pairs of the stop surfaces when the handling tool is in a second rotational position relative to the hanger body, means releasably securing the main body of the handling tool to the hanger body with the main body occupying said first position and with the main body being capable of rotation about its longitudinal axis relative to the hanger body, a tubular body slidably embracing the main body of the handling tool and having a lower end dimensioned to engage the upper end of the actuating sleeve of the seal means, means interconnecting the tubular body and the actuator sleeve and operative to prevent relative rotation therebetween, locator means carried by the tubular body and capable of coacting with the rotational orientation reference means of the tubular support structure, and means releasably securing the tubular body to the main body of the handling tool whereby, after the handling tool has been manipulated to land the hanger body on the internal surface of the tubular support structure in a rotational position determined by coaction of the locator means and the rotational orientation reference means, the main body of the handling tool can be rotated to its second position to allow the handling tool to be moved downwardly to force the actuating sleeve downwardly to energize the seal ring.

2. The combination defined in claim 1, wherein the upwardly directed stop surfaces are portions of the upper end surface of the hanger body.

3. The combination defined in claim 1, wherein the main body of the handling tool comprises an upper portion of larger diameter and a portion therebelow of smaller diameter, the larger and smaller diameter portions being joined by a transverse annular downwardly facing shoulder, and the combination further comprises an antifriction bearing located between the larger diameter portion and the upper end of the tubular body at said downwardly facing shoulder.

4. The combination defined in claim 1, wherein the main body of the handling tool comprises a lower end portion telescopically engaged in the upper end portion of the hanger body; and the means releasably securing the main body of the handling tool to the hanger body comprises an inwardly opening transverse annular latch groove in the hanger body, a plurality of latch segments carried by the lower end portion of the main body of the handling tool and engaged in the latch groove, the latch segments being movable inwardly to a position in which they are no longer engaged in the latch groove and being provided with inclined cam surfaces by which such movement can be accomplished, and an actuator sleeve carried by the lower end portion of the main body of the handling tool and arranged to be forced against the cam surfaces of the latch segments to disengage the latch segments from the latch groove as a result of the downward movement of the main body of the handling tool which energizes the seal ring.

5. In the installation of a multiple string tubing hanger in a tubular support structure located under water and having both an internal support surface and a rotational orientation reference means above the support surface, the improvement comprising providing a multiple string tubing hanger having an upper body portion of smaller diameter than the bore in which the hanger is to be installed;

placing on the upper body portion of the tubing hanger an annular seal device capable of being energized by being subjected to axial compression;

providing a handling tool having a body member and a sleeve member which surrounds the body member, is rotatable relative thereto and includes locator means capable of coacting with the rotational orientation reference means of the tubular support structure;

releasably securing the sleeve member of the handling tool to the body member of the handling tool in a predetermined rotational position;

releasably attaching the tubing hanger to the body member of the handling tool in such fashion that the handling tool can be rotated about the axis of the tubing hanger between a first position, in which the handling tool is blocked against downward movement relative to the tubing hanger, and at least one second position, in which the handling tool is unblocked and can be moved downwardly a significant distance relative to the tubing hanger;

running the combination of the handling tool and tubing hanger downwardly into the tubular support structure until the tubing hanger has landed on the internal support surface of the tubular support structure;

rotating the combination of the handling tool and tubing hanger until the locator means of the sleeve member of the handling tool coacts with the rotational orientation means of the tubular support structure;

releasing the body member of the handling tool for rotation relative to the sleeve member;

rotating the body member of the handling tool relative to the tubing hanger and the sleeve member of the handling tool to bring the body member to its second position; and lowering the handling tool body relative to the tubing hanger and thereby subjecting the seal device to axial compression to energize the seal device to seal between the tubing hanger and the tubular support structure.

6. The improvement defined in claim 5, further comprising releasing the handling tool from the tubing hanger as a result of said step of lowering the handling tool body relative to the tubing hanger.

* * * * *